US005628530A

United States Patent [19]

Thornton

[11] Patent Number: 5,628,530

[45] Date of Patent: May 13, 1997

[54] METHOD AND SYSTEM FOR COLLECTIVELY TRACKING DEMOGRAPHICS OF STARTER DRUG SAMPLES

[75] Inventor: Gary B. Thornton, Raleigh, N.C.

[73] Assignee: Info Tec LLC, Raleigh, N.C.

[21] Appl. No.: 571,122

[22] Filed: Dec. 12, 1995

[51] Int. Cl.[6] ..... B42D 15/00

[52] U.S. Cl. ..... 283/67; 283/900; 283/70

[58] Field of Search ..... 283/67, 70, 44, 283/48.1, 55, 56, 66.1, 117, 900

[56] References Cited

U.S. PATENT DOCUMENTS

| | | | |
|---|---|---|---|
| 4,807,909 | 2/1989 | Lapsker . | |
| 4,971,362 | 11/1990 | Lapsker . | |
| 5,090,734 | 2/1992 | Dyer et al. | 283/67 |
| 5,178,417 | 1/1993 | Eshoo | 283/67 |
| 5,401,059 | 3/1995 | Ferrario | 283/67 |

*Primary Examiner*—Willmon Fridie, Jr.

[57] ABSTRACT

A method and system for collectively tracking demographics of physician (12,14) prescribed starter drug samples dispensed to a plurality of patients (18,20) from a plurality of different dispensing locations (38,40) employs a multipart product specific sample drug voucher, such as a smart card (100) or a preprinted two part voucher (102), which has a marketing information portion (30,34) and a separable prescription portion (32,36) to be completed by the prescribing physician with starter drug sample quantity and dosage information along with patient demographic information. The prescription portion (32,36) is segregated from the marketing information portion (30,34) at the pharmacy (38,40) either electronically by a card reader (112), if it had been encoded on a smart card (100) by the physician (12,14), or physically by separation along a perforation (50), if recorded on a two part voucher (102), and is electronically retreivably stored in the pharmacy computer (130) from where this tracking information is electronically transmitted to a central remote computer (134), such as at the drug manufacturer, for subsequent rapid market analysis (136).

12 Claims, 4 Drawing Sheets

METHOD AND SYSTEM FOR COLLECTIVELY TRACKING DEMOGRAPHICS OF STARTER DRUG SAMPLES

BACKGROUND OF THE INVENTION

1. Field of the Invention

The present invention relates to methods and systems for collectively tracking demographics of starter drug samples and particularly to collectively tracking demographics of such samples dispensed to a plurality of patients from a plurality of different dispensing locations so that the dispensing of advertised starter drug samples provided to the plurality of patients at diverse locations under the direction of the physician for each of the patients may be rapidly tracked and analyzed.

2. Description of Prior Art

It is well known that in the marketing and promotion of drugs and other pharmaceuticals it is a common practice for the manufacturers of such drugs to provide starter samples to physicians. The physicians then normally provide their patients with such starter samples free of charge so that a physician can determine whether or not the particular drug is suitable for the needs of the individual patient without the patient having to incur the expense of initially purchasing the product. Similarly such practice is also advantageous to the manufacturer of the drugs since it allows the physician to become familiar with the drug while also allowing the patient to become familiar with the drug without initially having to incur an expense. However, the manufacturers of these drugs normally do not have any way of tracking the dispensing of these drugs by the physician with respect to the dosage amount, quantity amount, or the demographics of the patients to whom these drugs are dispensed. Such information would be helpful to the drug manufacturer in terms of doing a market analysis as to the usage and dispensing of these drugs including the geographical distribution of these drugs and market penetration throughout the country. This type of marketing information can be of great value to pharmaceutical manufacturers. Up to the present time applicant is not aware of any satisfactory system which allows this to be done.

There have been prior art attempts, such as described in U.S. Pat. Nos. 4,971,362 and 4,807,909 to provide control stubs or other simple mechanisms using preprinted prescriptions for sample dosages in an effort to control their dispensing. These prior art systems have involved the dispensing of these drugs by the pharmacist in response to the preprinted prescription. However, these systems do not permit or provide for a varying of the dosage or quantity to be dispensed by the physician nor do they enable rapid reporting by the pharmacy back to the drug manufacturer so that vital marketing information can be obtained by the drug manufacturer. For example, such systems do not take advantage of electronics or computer processing to facilitate such transfer nor do they take advantage of modern-day conventional smart card technology for use by the pharmacist and the physician to effectuate rapid tracking of this information and provision of it to the drug manufacturer. Furthermore, such prior art systems known to applicant do not provide for marketing information with respect to the particular drug starter sample to be provided in conjunction with a variable prescription blank to be completed by the physician. These disadvantages of the prior art are overcome by the present invention.

SUMMARY OF THE INVENTION

The present invention relates to a method and system for collectively tracking demographics of starter drug samples dispensed to a plurality of patients from a plurality of different dispensing locations. The dispensed starter drug samples are prescribed by a plurality of physicians at a plurality of different prescription locations. The method and system of the present invention comprises the steps of providing a multipart product specific sample drug voucher for use by each of the plurality of physicians at the prescription locations for prescribing the starter drug sample for a given patient in the plurality of patients at one of the prescription locations. The multipart drug voucher comprises a first portion containing marketing, advertising or patient education information for a starter drug sample to be prescribed to the given patient by the physician at the prescription location and a second portion comprising a variable drug prescription for the advertised starter drug sample to be completed by the physician for prescribing a variable starter drug sample quantity and dosage for the advertised starter drug sample for the given patient whose patient demographics are also entered in the second portion. The variable drug prescription second portion is separable from the marketing information first portion either electronically or physically to enable the prescribed starter drug sample to be dispensed in accordance therewith by a pharmacist at one of the plurality of dispensing locations in accordance with the completed drug prescription.

The physician completes the drug prescription at the prescription location which is remote from the dispensing location. The completed drug prescription contains the variable starter drug sample quantity and the dosage selected by the physician as well as the patient demographic information for the given patient. The completed drug prescription is then separated from the marketing information portion by the pharmacist in order to provide the completed drug prescription at the dispensing location. This separation can occur electronically, if the information is electronically recorded, or can be physically accomplished if a multi part drug voucher, such as one having perforations between the portions, is used. The patient demographic, sample quantity, and dosage information at each of the dispensing locations is then electronically retrievably stored from each of the drug prescription portions. If a smart card is used to electronically store this information in the first instance, then the smart card which has been encoded with this information may be decoded at the pharmacy via a conventional card reader and input to the pharmacy computer for providing tracking information for the dispensed prescribed starter drug samples. If, instead, the prescription and patient demographic information is contained on a written voucher, then this information may be electronically input at the pharmacy location and, thereafter, transmitted electronically from the pharmacy computer to a processing company. In either instance, the tracking information is electronically transmitted from each of the dispensing locations to a common remote collection/processor location for collective market analysis of the transmitted tracking information so that the dispensing of the advertised starter drug samples provided to the plurality of patients at diverse locations under the direction of their physicians may be rapidly tracked and analyzed by the drug manufacturer.

DETAILED DESCRIPTION OF THE PREFERRED EMBODIMENT

Figure 1:
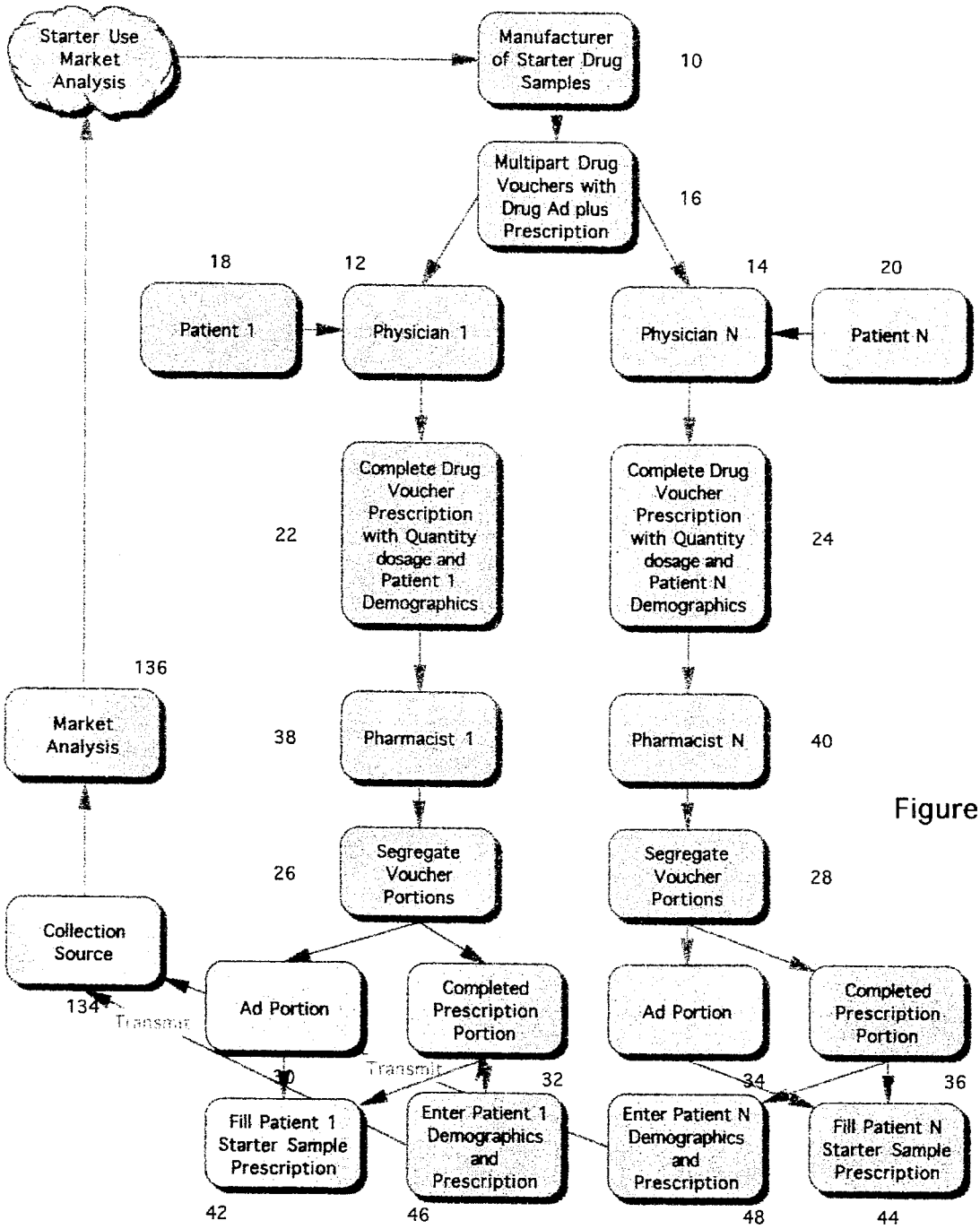
FIG. 1 is a schematic flow diagram of the presently preferred method of the present invention.

Referring to the drawings in detail, and initially to FIG. 1 thereof, the presently preferred method for collectively tracking demographics of starter drug samples dispensed to a plurality of patients from a plurality of different dispensing locations is illustrated. As shown by way of example in FIG. 1, the point of origin of the starter drug samples is the manufacturer of the starter drug samples represented by reference numeral 10. The manufacturer 10 normally provides the starter drug samples to sales representatives who, in turn, normally provide these starter drug samples to physicians, such as the plurality of physicians represented by "PHYSICIAN 1" through "PHYSICIAN N" in FIG. 1, as represented by reference numerals 12 and 14.

In accordance with the presently preferred method of the present invention, the physician 12,14 is provided with a multipart drug voucher 100,102 instead of with an actual sample of the drug. This step is represented by reference numeral 16 in FIG. 1. The multipart drug voucher 100,102, as will be described in greater detail hereinafter with reference to FIGS. 2–5, may either be an electronic smart card, as shown by way of example in FIG. 2 and represented by reference numeral 100, or may be a multipart paper form as represented by reference numeral 102 in FIGS. 4 and 5. In either instance, in accordance with the presently preferred method and system of the present invention, the starter drug samples to be dispensed are initially prescribed by the physicians 12,14 at a plurality of different prescription locations with the individual physicians 12, 14 each prescribing what they deem to be a necessary starter drug sample for their respective patients 18,20. In this regard the starter drug sample dosage may be selected by the physician 12,14. The physician 12,14, in completing the multipart drug voucher 100,102, either electronically in the instance of a smart card 100, or manually as in the instance of the perforated multipart drug voucher 102, preferably inserts, in addition to the dosage and quantity information, patient demographic information such as the name, address, and identification number of the patient, and then either signs the paper prescription form 102 or, in the instance of a smart card 100, puts in an electronic identification. This step of validating the drug voucher 100,102 prescription with quantity dosage and patient demographics is represented in FIG. 1 by reference numerals 22 and 24.

Figure 2:
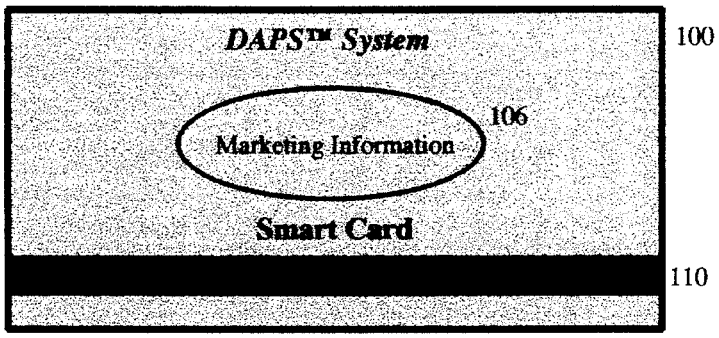
FIG. 2 is a graphical illustration of a typical smart card usable with the system and method of the present invention.
Figure 3:
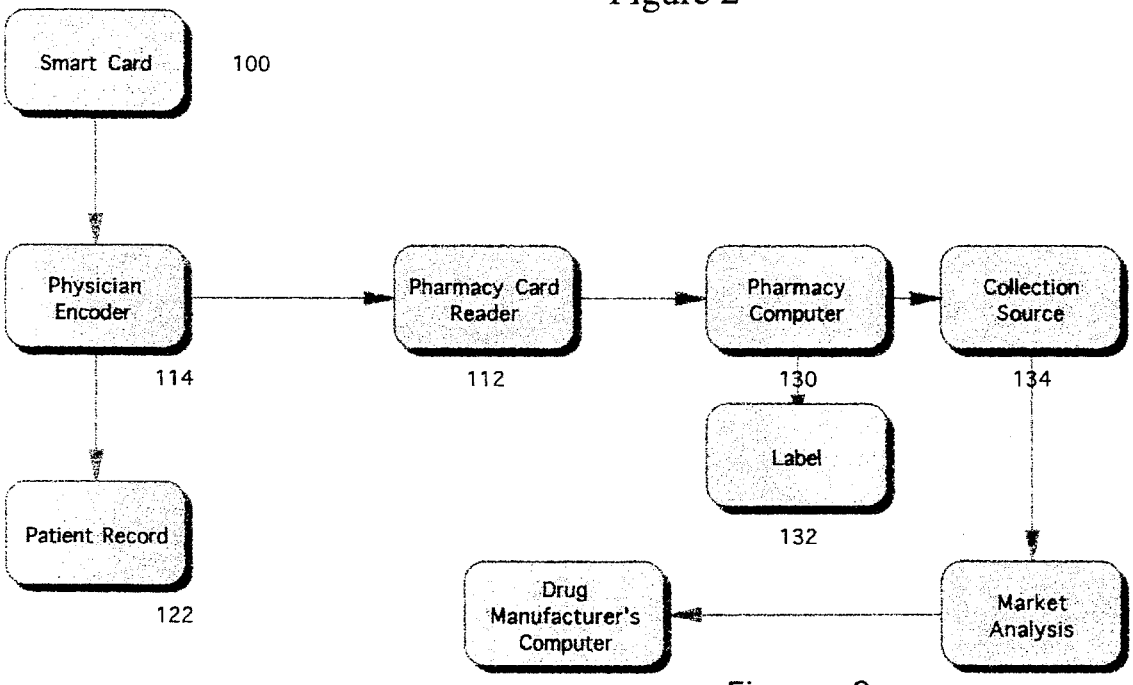
FIG. 3 is a block diagram illustrative of a presently preferred method and system in accordance with the present invention for use with the smart card of FIG. 2.
Figure 4:
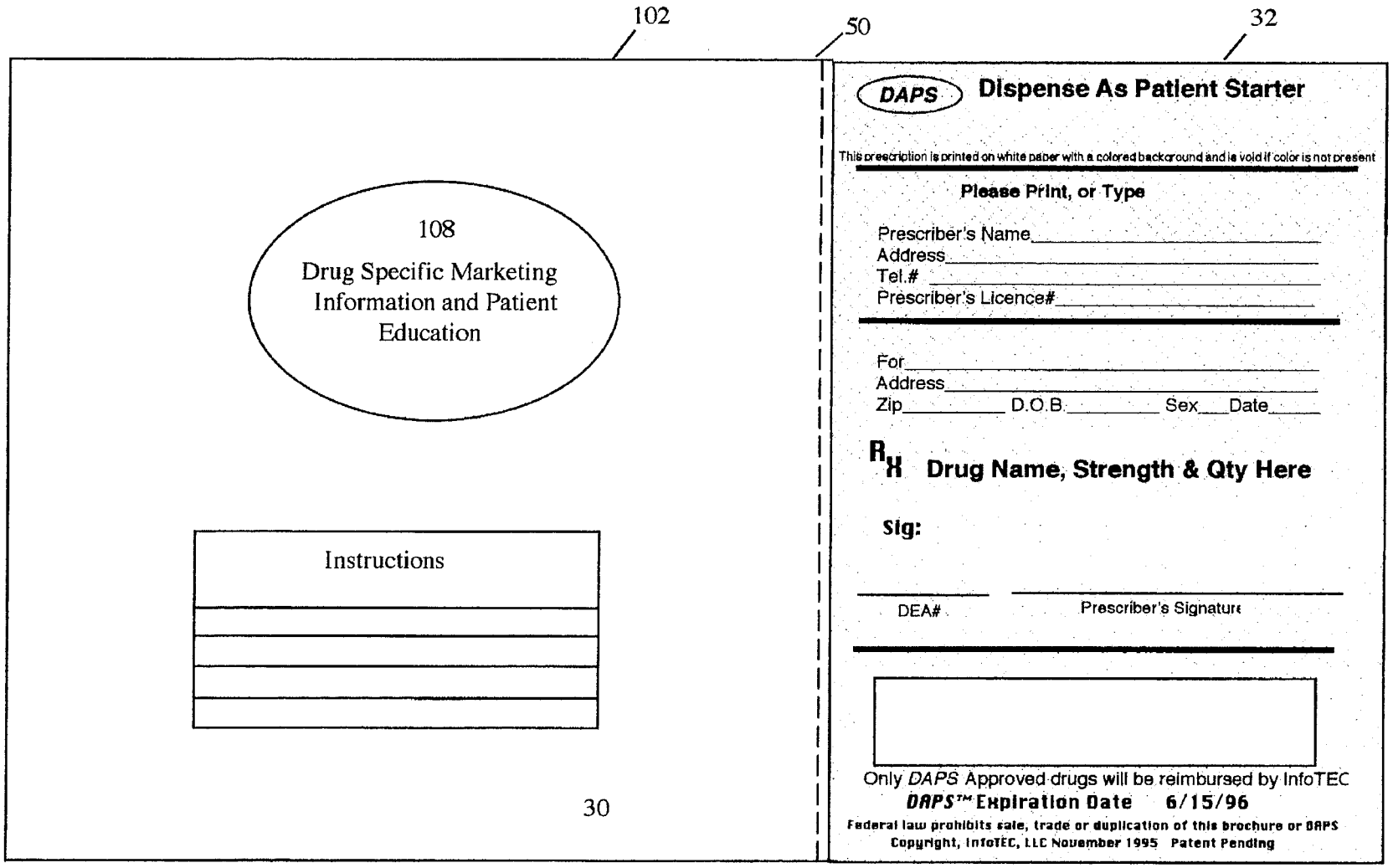
FIG. 4 is a graphical illustration of a typical two part drug voucher for use with the presently preferred method and system of the present invention.
Figure 5:
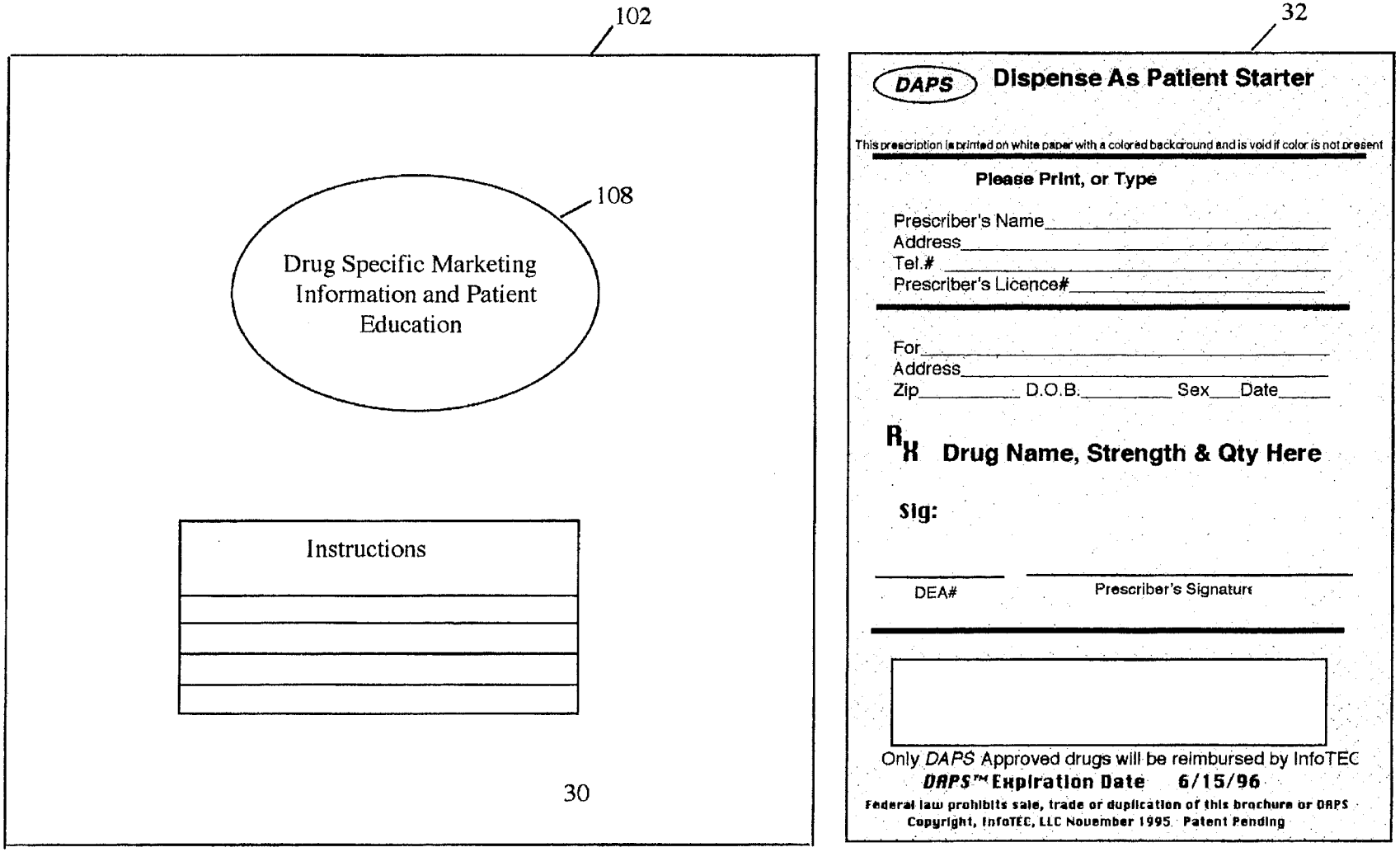
FIG. 5 is an illustration similar to FIG. 4 of the drug voucher of FIG. 4 separated into two parts.

After the drug voucher 100,102 is validated by the physician 12,14 and given to the patient 18,20, the completed drug voucher 100,102, which also preferably contains marketing information specific to the drug sample to be dispensed, such as represented by reference numeral 106 in FIG. 2 and 108 in FIGS. 4 and 5, is separated or segregated into two portions, one portion 30 containing the marketing/patient education information 106,108 and the other portion 32 containing the completed drug voucher prescription and patient demographic information. This segregation or separation step is represented by reference numerals 26 and 28 in FIG. 1. If the information is contained on a smart card 100, then this separation is preferably accomplished electronically with the prescription and patient demographic information preferably being contained on a card readable magnetic stripe 110, in conventional fashion, which may be read by a conventional card reader 112, such as represented in FIG. 3, at the pharmacy, such as the type of reader 112 which is normally used to read smart cards.

The smart card 100 itself is preferably encoded at the location of the physician 12,14 in conventional fashion by using a conventional encoder 114 of the type used with such smart cards 100 to encode information on the magnetic stripe 110. In this regard the magnetic stripe 110 is preferably encoded with patient information, prescriber or physician information, product information, dosage instructions and, if desired, special instructions for the pharmacist or patient, with the marketing or advertising information 106 being clearly visible on the front of the smart card 100. This electronically encoded information, which is preferably in a digital format, is preferably transferred to the patient's record 122 (FIG. 3) at the physician's office, if desired, by a conventional readout from the physician encoder 114, as well as preferably being retrievably stored in the magnetic stripe 110 on the smart card 100 for subsequent reading and retrieval by the pharmacy card reader 112 at the pharmacy selected by the patient 18,20 to dispense the prescribed starter drug samples.

As shown and preferred in FIG. 3, the pharmacy card reader 112 is conventionally connected as an input device to the conventional pharmacy computer 130 which transfers this information to the pharmacy computer 130 and, preferably, in conventional fashion, also automatically produces a label 132 with complete information for dispensing of the prescribed medication in the prescribed dosage and quantity for the starter drug sample, as well as create a data record for this tracking information. The tracking information is then preferably transferred, such as being electronically transmitted, via conventional telephone lines or modem, to the electronic processor's computer 134, which is preferably a conventional computer capable of receiving and processing this digital information. The processor's computer 134 is preferably conventionally programmed to do market analysis on this tracking information, such as determining the distribution and usage of the dispensed starter drug samples. Preferably, in the instance of a smart card 100, the smart card 100 is encoded for only a one-time use and is subsequently retrieved by the company personnel for the drug manufacturer from the pharmacy where the prescribed starter drug sample has been dispensed or may be mailed back by the pharmacist to the drug manufacturer for reuse.

The aforementioned steps in this process are illustrated in FIG. 1, which shows the segregation of the drug voucher portion into the drug specific ad or marketing information portion 30 and the completed prescription portion 32 or, similarly, into the ad/education portion 34 to remain with the patient and the completed drug prescription portion 36, with the completed drug prescription portion, as previously described, being provided to the respective pharmacist 38, 40 who dispense or fill the starter drug sample prescriptions, as represented by reference numerals 42, 44, respectively, and enter the patient demographics and prescription information, as represented by reference numerals 46,48, respectively. This information is then preferably electronically transmitted to a remote control collection source, such as the drug manufacturer's computer 134, where the market analysis takes place in accordance with a conventional program, as represented by reference numeral 136 in FIG. 1.

Referring now to FIGS. 4 and 5, the previously mentioned manual drug voucher form 102 for accomplishing the same as is accomplished by use of the smart card 100 described with reference to FIGS. 2 and 3, is shown. In that instance, the ad/education portion 30 preferably contains preprinted information which is drug specific marketing information and may contain further instructions for promoting the starter drug sample to the patient 18,20 as well as to the physician 12,14 while the voucher is in the physician's possession, and has secured to it the drug prescription blank 32 which contains information to be subsequently completed by the physician 12,14. This information preferably comprises the dosage, such as how many times per day, patient demographic or data such as name, address, and identification, and information with respect to the physician prescribing the medication, including his or her identification. These two portions 30, 32 are preferably secured to each other along a perforation 50 and may be conventionally separated into two portions, as illustrated in FIG. 5, along this perforation. The second portion 32,36, which is the completed prescription portion, is then preferably presented to the pharmacist who, in this instance, will preferably electronically insert this information into the pharmacy computer 130 via a conventional keyboard. Thereafter, this information may be processed in the same manner as previously described with respect to the smart card 100 for producing patient labels 132 for the dispensed starter drug sample and electronic transmission of this information from the pharmacy computer 130 to the drug manufacturer's computer 134 for subsequent market analysis.

In each instance, the presently preferred method and system of the present invention enables the physician to directly interact with his or her patient and prescribe the required initial starter drug sample without having to stock it, rather than to merely give away a predetermined amount irrespective of patient need, allows the patient to obtain timely drugs in the normal manner from his or her pharmacist, and allows the drug manufacturer to rapidly obtain valuable market survey information regarding the use and geographic distribution of drug samples. Thus, the presently preferred method and system of the present invention provides substantial benefit at all levels to patients, physicians, pharmacists, and drug manufacturers and adds order to the chaos of prior starter drug sampling methods.

DAPS™ processing provides patient name information and or membership numbers which can be traced to a patient name. This information can be processed into a report or electronic mail format. The intended use of this information would be to provide the originating physician the information on the compliance of their patients regarding their prescribed medication. The reports would be available weekly or in whatever time frame the requesting physician dictates. If the on-line option was taken, the information would be posted upon processing into a secured mailbox utilizing the DAPS™ Online system which will be developed for this purpose.

The physician would have the ability to have his staff download the information or process the reports concerning patients that he has prescribed medications for. Any non-compliant patients would be contacted either by the office or by a contracting company to ascertain the reasons for their non-compliance. This program is best suited to the Managed Care organizations where non-compliance with a prescriber's therapy often results in another health care visit, thus additional costs to the HMO. Follow up calls from the physicians have been found to be good for business. The DAPS™ usage information termed DAPSBaK™, provides yet another viable resource of patient information to help prescribers care for their patients.

Information of this type has never been available before. Neither sample nor prescription information regarding patient compliance is available back to the originating prescriber. This is due to the numerous pharmacy choices patients have. DAPS™ processing makes this information readily available.

I claim:

1. A method for collectively tracking demographics of starter drug samples dispensed to a plurality of patients from a plurality of different dispensing locations, said dispensed starter drug samples being prescribed by a plurality of physicians at a plurality of different prescription locations, said method comprising the steps of:

(a) providing a multipart product specific sample drug voucher for use by each of said plurality of physicians at said prescription locations for prescribing said starter drug sample for a given patient in said plurality of patients at one of said prescription locations, said multipart drug voucher comprising a first portion containing marketing information for advertising a starter drug sample to be prescribed to said given patient by the physician at said one prescription location and a second portion comprising a variable drug prescription for said advertised starter drug sample to be completed by the physician for prescribing a variable starter drug sample quantity and dosage for said advertised starter drug sample for said given patient, said variable drug prescription second portion being separable from said marketing information first portion for enabling said prescribed starter drug sample to be dispensed in accordance therewith by a pharmacist at one of said plurality of dispensing locations in accordance with said completed drug prescription second portion;

(b) completing said drug prescription second portion at said one prescription location, said prescription locations being remote from said dispensing locations, said completed drug prescription second portion comprising said variable starter drug sample quantity and dosage and patient demographic information for said given patient;

(c) separating said completed drug prescription second portion from said marketing information first portion for providing said completed drug prescription second portion to the pharmacist at said one location for dispensing of said prescribed drug sample at said one dispensing location in accordance with said variable starter drug sample quantity and dosage contained on said separated completed drug prescription second portion;

(d) electronically retrieving and storing the patient demographic and sample quantity and dosage information at each of said plurality of dispensing locations from each of said separated completed drug prescription second portions for providing tracking information for said dispensed prescribed starter drug samples; and (e) electronically transmitting said tracking information from each of said plurality of dispensing locations to a common remote collection location for collective market analysis of said transmitted tracking information; whereby the dispensing of advertised starter drug samples provided to said plurality of patients at diverse locations under the direction of the physician for each of said patients may be rapidly tracked and analyzed.

2. A method for tracking demographics of dispensed drug samples in accordance with claim 1 wherein said completing step comprises the step of electronically recording said patient demographic and variable starter quantity and dosage information.

3. A method for tracking demographics of dispensed drug samples in accordance with claim 2 wherein said retrieving and storing step comprises the step of retrieving and storing said electronically recorded information.

4. A method for tracking demographics of dispensed drug samples in accordance with claim 3 wherein said drug voucher comprises electronic storage media capable of electronically recording said electronically recorded information, said retrieving step comprising the step of retrieving said electronically recorded information from said electronic storage media.

5. A method for tracking demographics of dispensed drug samples in accordance with claim 4 wherein said electronic storage media comprises a digital information storage media, said electronic recording comprising digital recording, said recorded information being in a digital format.

6. A method for tracking demographics of dispensed drug samples in accordance with claim 1 wherein said first and second portions of said drug voucher are initially secured to each other along a perforated portion, said separating step comprising the step of detaching said completed drug prescription second portion from said marketing information first portion along said perforated portion for providing said separated completed drug prescription second portion.

7. A system for collectively tracking demographics of starter drug samples dispensed to a plurality of patients from a plurality of different dispensing locations, said dispensed starter drug samples being prescribed by a plurality of physicians at a plurality of different prescription locations, said system comprising a multipart product specific sample drug voucher capable of use by each of said plurality of physicians at said prescription locations for prescribing said starter drug sample for a given patient in said plurality of patients at one of said prescription locations,, said multipart drug voucher comprising a first portion containing marketing information for advertising a starter drug sample to be prescribed to said given patient by the physician at said one prescription location and a second portion comprising a variable drug prescription for said advertised starter drug sample dependent on a variable starter sample quantity and dosage determined by the physician for said given patient and patient demographic information for said given patient, said variable drug prescription second portion being separable from said marketing information first portion for enabling said prescribed starter drug sample to be dispensed in accordance therewith by a pharmacist at one of said plurality of dispensing locations in accordance with said completed drug prescription second portion; means for electronically retrievably storing the patient demographic and sample quantity and dosage information at each of said plurality of dispensing locations from each of said separated drug prescription second portions for providing tracking information for said dispensed prescribed starter drug samples and for electronically transmitting said retreivably stored tracking information to a common remote collection location from each of said plurality of dispensing locations; and means for collectively processing said transmitted tracking information at said remote collection location for providing a collective market analysis of said tracking information; whereby the dispensing of advertised starter drug samples provided to said plurality of patients at diverse locations under the direction of the physician for each of said patients may be rapidly tracked and analyzed.

8. A system for tracking demographics of dispensed drug samples in accordance with claim 7 wherein said drug voucher comprises electronic storage media capable of retrievably storing said patient demographic and variable starter quantity and dosage information.

9. A system for tracking demographics of dispensed drug samples in accordance with claim 8 wherein said electronic storage media comprises digital information storage media, said retrievably stored information being in a digital format.

10. A system for tracking demographics of dispensed drug samples in accordance with claim 7 wherein said first and second portions of said drug voucher are initially secured to each other along a perforated portion, said marketing information first portion and said drug prescription second portion being separable along said perforated portion for providing said separated drug prescription second portion.

11. A system for tracking demographics of dispensed drug samples in accordance with claim 7 wherein said variable drug prescription second portion comprises means for enabling the physician to variably insert the starter quantity and dosage for said given patient at said one prescription location.

12. A system for tracking demographics of dispensed drug samples in accordance with claim 11 wherein said drug voucher comprises a smart card.

* * * * *